United States Patent [19]

Geib et al.

[11] Patent Number: 4,781,618

[45] Date of Patent: Nov. 1, 1988

[54] PUSHBUTTON ELECTRICAL TERMINAL

[75] Inventors: Lawrence E. Geib, Carol Stream; Herbert C. Naylor, West Dundee, both of Ill.

[73] Assignee: Reed Devices, Inc., Carol Stream, Ill.

[21] Appl. No.: 66,868

[22] Filed: Jun. 25, 1987

[51] Int. Cl.[4] ..... H01R 4/24

[52] U.S. Cl. ..... 439/392; 439/417

[58] Field of Search ..... 439/389, 391, 392, 395, 439/396, 417, 418

[56] References Cited

U.S. PATENT DOCUMENTS

| | | | |
|---|---|---|---|
| 2,651,768 | 9/1953 | Oortgijsen | 439/392 |
| 3,897,993 | 8/1975 | Fleischhacker | 439/392 |
| 4,002,856 | 1/1977 | Sedlacek et al. | 179/98 |
| 4,112,261 | 9/1978 | Shiff | 179/99 |
| 4,126,935 | 11/1978 | Rhines et al. | 29/628 |
| 4,255,792 | 3/1981 | Das | 364/580 |
| 4,431,247 | 2/1984 | Abdullah | 439/392 |
| 4,494,859 | 1/1985 | Frias et al. | 355/5 |
| 4,628,236 | 12/1986 | Schaefer | 318/558 |

*Primary Examiner*—Joseph H. McGlynn

*Attorney, Agent, or Firm*—Weingarten, Schurgin, Gagnebin & Hayes

[57] ABSTRACT

An electrical binding post operative by use of a pushbutton which serves as an insertion and removal tool and which, upon installation into the associated post, becomes an integral part of the completed terminal. An unstripped wire is inserted within an opening provided in the pushbutton plunger element which is installed into the terminal body to cause insulation displacement contact of the wire and retention of the plunger within the terminal body.

11 Claims, 3 Drawing Sheets

PUSHBUTTON ELECTRICAL TERMINAL

FIELD OF THE INVENTION

This invention relates to electrical terminals and more particularly to a pushbutton terminal for attachment of an electrical wire to the terminal.

BACKGROUND OF THE INVENTION

Electrical terminals, often called binding posts, are known for connection of an electrical wire to the terminal. The wire must be stripped of its insulation to provide a length of uninsulated bare wire which is wrapped or otherwise connected to the terminal post. The terminal post can be of the screw type in which the wire is wrapped around the screw and the screw tightened to complete the connection. Alternatively, the terminal post can have an opening or channel for acceptance of the stripped wire end and spring biased means which clamp the wire end to complete the connection. A variety of such terminal posts have been employed over the years, but all require the stripping of wire ends for attachment to the posts. A self-stripping terminal strip is sold by the 3M Company as the SS-25 Self Strip Termination Block, in which an unstripped wire is inserted into an opening in a post, and a cap on the post is rotated with a screwdriver to cause stripping of the inserted wire and completion of electrical connection. The iserion of wires in center rows of an array of such terminals is often difficult by reason of the limited access to the insertion openings. In addition, a screwdriver or other similar tool is needed to twist the cap of such terminals.

SUMMARY OF THE INVENTION

The present invention provides a binding post which is operative by use of a pushbutton which serves as an insertion tool and a removal tool, and which upon installation into the associated post becomes an integral part of the completed terminal. In use, an unstripped wire end is inserted within an opening provided in the pushbutton plunger element, which is then installed into the terminal body causing insulation displacement contact (IDC) of the wire and terminal and retention of the plunger within the terminal body to complete the connection. For removal, the pushbutton is manually raised to permit access to the wire which can be removed and replaced as necessary. The improved terminal post is operative without the use of tools and requires simple manipulation by the fingers of a user. The pushbutton can be easily depressed to expose adjacent posts for ease of wire insertion.

DESCRIPTION OF THE DRAWINGS

The invention will be more fully understood from the following detailed description taken in conjuction with the accompanying drawings in which.

DETAILED DESCRIPTION OF THE INVENTION

Figure 1:
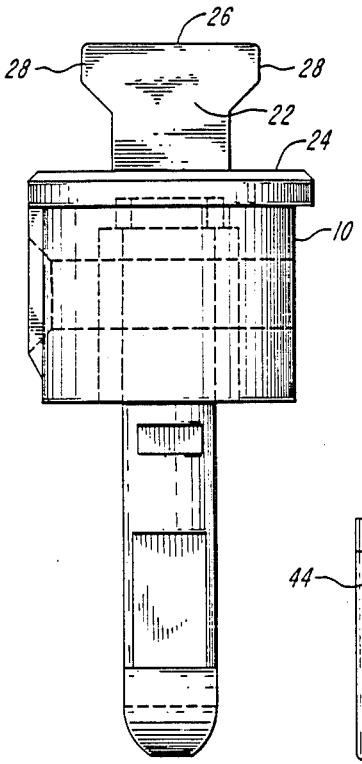
FIG. 1 is an elevation view of the pushbutton plunger element in accordance with the invention.
Figure 2:
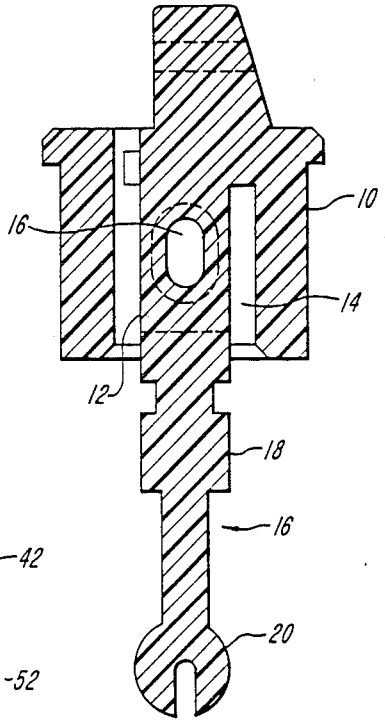
FIG. 2 is an elevation view of the pushbutton element of FIG. 1 shown in an orthogonal position to that of FIG. 1.

Referring to FIGS. 1 and 2, there is shown a pushbutton plunger element which includes an enlarged, generally cylindrical portion 10 having a coaxially disposed post section 12 defining an anular space 14. An elongated opening 16 is provided through the post section 12 and sized to receive one or two wires therein to be connected. The post section has an outward extension 16 including an enlarged portion 18 disposed intermediate along the length of section 16, and an enlarged end portion 20. A handle portion 22 outwardly extends from the cap surface 24 and includes an outer surface 26 upon which thumb or finger pressure can be applied to seat the plunger into the terminal body, and laterally extending tabs 28 to provide finger-gripping portions for removal of the plunger from the terminal body. The plunger is preferably formed of an electrically insulative material and typically is integrally molded of a suitable plastic material.

Figure 3:
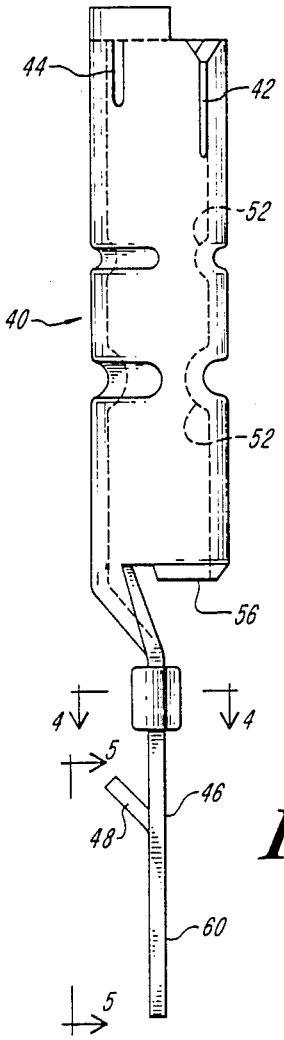
FIG. 3 is an elevation view of the terminal body in accordance with the invention.
Figure 4:
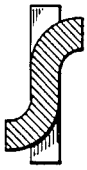
FIG. 4 is a sectional view taken along lines 4—4 of FIG. 3.
Figure 5:
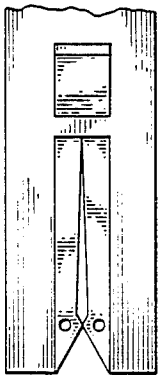
FIG. 5 is a view taken along lines 5—5 of FIG. 3.

The terminal body is shown in FIGS. 3 through 5 and includes a generally tubular section 40, having an open end with an insulation displacement groove 44 and a shorter cut/trim groove 42 diametrically disposed, and at the opposite end an outwardly extending terminal portion 46, which includes an angularly outward tab 48. Axially spaced beads 50 and 52 are provided around at least a portion of the perimeter of section 40. The S-shpaed cross-section, shown in FIG. 4, can be provided to center the terminal in a mounting hole.

Figure 6:
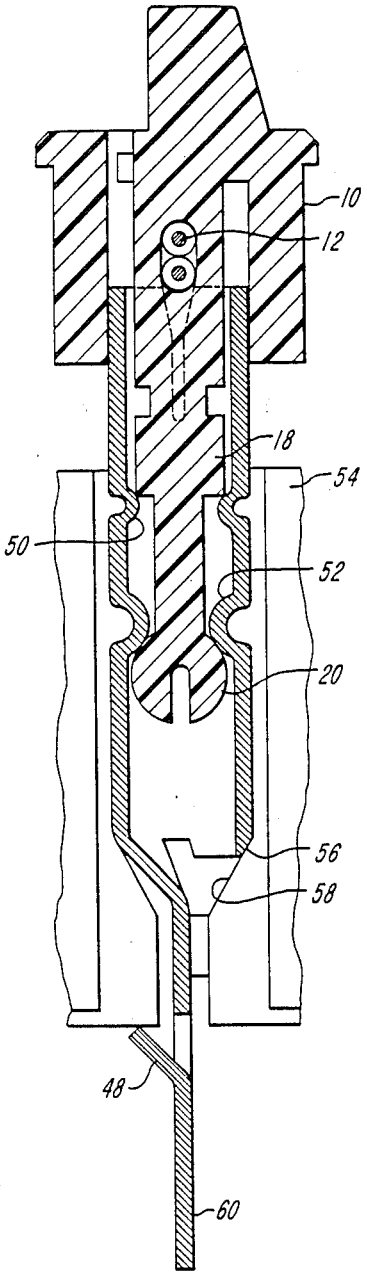
FIG. 6 is a sectional elevation view illustrating the pushbutton plunger element inserted into the terminal body.
Figure 7:
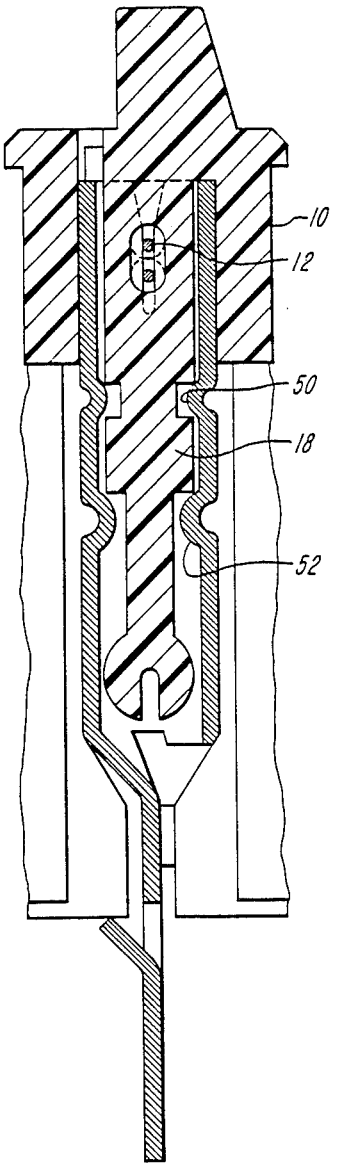
FIG. 7 is a sectional elevation view showing the plunger element seated in the terminal body.

The terminal body is mounted with tubular section 40 disposed within an opening provided in a mounting board or other mounting member 54, as shown in FIGS. 6 and 7. The insertion depth of the body section 40 in the mounting opening is defined by the engagement of lip 56 with the confronting conical wall 58 of the mounting opening. The tab 48 is sufficiently resilient to yield during insertion of the terminal body into the mounting opening and to spring open after clearance of the opening to the position shown in FIG. 6 to serve as a stop against withdrawal of the terminal body from the mounting member.

The outer end 60 of the terminal body can be of any suitable configuration for connection to electrical wiring. An insulation displacement-type contact, as shown in FIG. 5, can be provided on the terminal end 60. Alternatively, wires can be soldered or otherwise affixed to a correspondingly configured terminal end.

Figure 8:
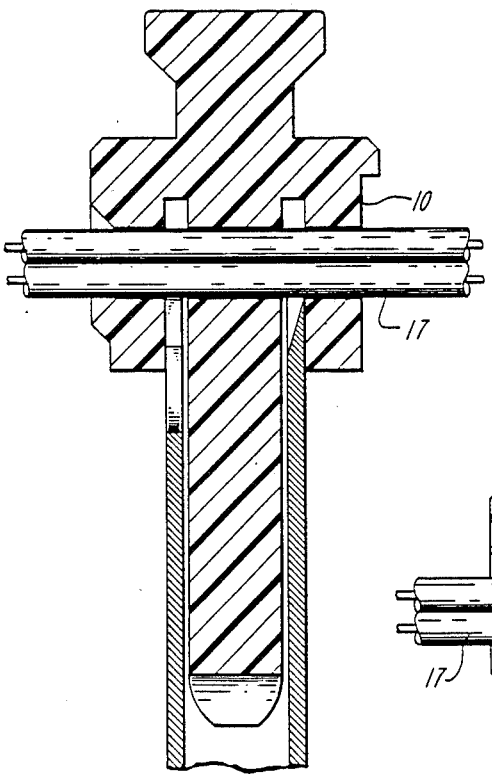
FIG. 8 is a sectional elevation view showing wires inserted in the raised plunger element.
Figure 9:
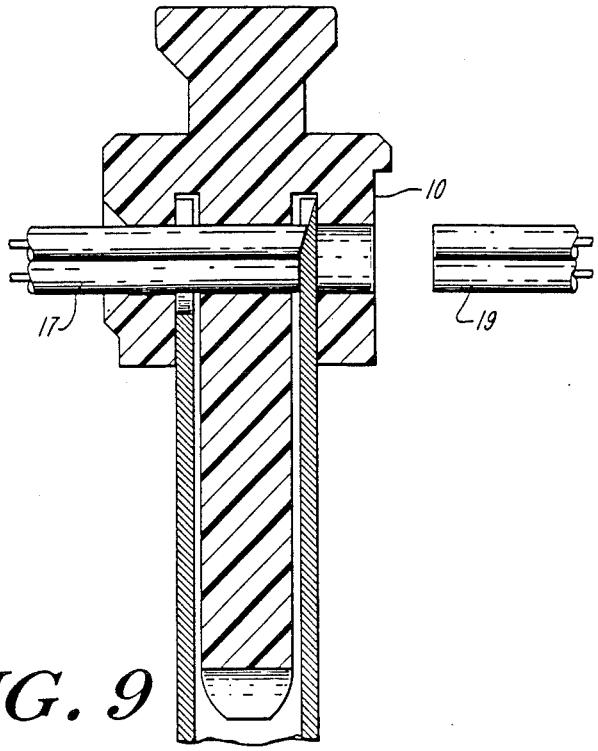
FIG. 9 is a sectional elevation view showing the connected wires in the seated plunger element.

The pushbutton terminal is operative in the following manner. An unstripped wire or wires 17 is inserted into opeing 16 of plunger 10, and the plunger is inserted onto the mounted terminal body, as shown in FIGS. 6 and 8. Typically, the plunger is in the position shown in FIG. 6 and retained in that position by abutment of section 18 and bead 50, and abutment of portion 20 and bead 52. In this position, the opening 16 is exposed for insertion of the connecting wire or wires. After insertion of the wire into opening 16, the plunger is manually depressed to its seated position as shown in FIGS. 7 and 9. In this seated position, the section 18 is disposed between beads 50 and 52 to remain latched into its seated position. The downward movement of the plunger in the terminal body causes depression of the wire into the grooves 42 and 44. The confronting groove walls of groove 44 slice through or displace the wire insulation and electrically contact the wire. The groove 44 is shallower than the groove 42 and has a sharp bottom edge to provide a guillotine action for severing the free end 19 of the wire or wires as the plunger is seated.

For removal of the wire or wires from the terminal, the plunger 10 is manually raised to the position shown in FIG. 6, to expose the opening 16 for access to the wire carried therein to permit removal and replacement, as necessary.

The plunger itself serves as an insertion and removal tool, which is operative solely by manual or finger force. No other or separate tools are necessary for using the novel terminal.

The terminal body can be made of a variety of conductive materials and typically is stamped and formed from a brass alloy.

The invention is not to be limited by what has been particularly shown and described, except as indicated in the appended claims.

What is claimed is:

1. A pushbutton electrical terminal comprising:

a terminal body of electrically conductive material, having a tubular section adapted for mounting within a mounting opening of a mounting member;

said tubular section having an open end with an insulation displacement contact provided thereon, and an electrical terminal lead outwardly extending from the other end of the tubular section;

a plunger of electrically insulative material, having a head portion adapted to fit over the open end of the tubular section, a coaxial post portion adapted to fit within the tubular section, a transverse opening in the post portion for receiving an insulated wire therethrough;

the plunger being movable with respect to the terminal body and along a longitudinal axis of the tubular section to force the wire disposed in the transverse opening into the insulation displacement contact of the tubular section to cause contact of the wire and terminal body; and means on the tubular body and the plunger cooperative to latch the plunger in a lower position.

2. The electrical terminal of claim 1 wherein the tubular section includes a groove opposite to the insulation displacement contact and operative to cut the free end of a wire disposed in the transverse opening of the plunger when the plunger is moved to the lower position.

3. The electrical terminal of claim 1 wherein the plunger includes a handle portion outwardly extending from a cap surface and having an outer surface upon which a thumb or finger pressure can be applied to seat the plunger into the terminal body and laterally extending tabs to provide finger-gripping portions for raising of the plunger.

4. The electrical terminal of claim 3 further including an enlarged portion on the post portion cooperative with ridges in the tubular section for maintaining the plunger in upper and lower portions.

5. A pushbutton electrical terminal comprising:

a terminal body of electrically conductive material having a tubular section adapted for mounting within a mounting opening;

said tubular section having an open end with an insulation displacement contact provided thereon and an electrical terminal lead outwardly extending from the end of the tubular section opposite to the open end;

a first bead disposed inwardly of the tubular section at a first axial position thereon;

a second bead disposed inwardly of the tubular section at a second axial position thereon;

a plunger of electrically insulative material having a head portion adapted to fit over the open end of the tubular section;

a coaxial post portion adapted to fit slidably within the tubular section;

a transverse opening in the post portion and adapted for receiving an insulated wire therethrough;

an enlarged section of the post portion being configured to cooperate with the first bead for maintaining the plunger in an upward position and cooperative with the first and second beads for maintaining the plunger in a lower position;

the plunger in the lower position being operative to force the wire disposed in the transverse opening in the insulation displacement contact.

6. The electrical terminal of claim 5 wherein a first groove in the wall of the tubular section serves as the insulation displacement contact, and wherein the tubular section includes a second groove in the wall thereof diametrically disposed from the first groove and shorter than the first groove;

the second groove being operative to cut the wire disposed in the transverse opening of the plunger when the plunger is moved to the lower position.

7. The electrical terminal of claim 6 wherein the plunger is of unitary construction.

8. The electrical terminal of claim 7 wherein the plunger is of molded plastic.

9. The electrical terminal of claim 6 wherein the terminal lead has an insulation displacement contact.

10. The electrical terminal of claim 6 wherein the terminal lead of the terminal body is operative to maintain the terminal body in a mounting opening.

11. The electrical terminal of claim 6 wherein the terminal lead includes a portion for engaging a mounting surface to retain the terminal body in a mounting opening.

* * * * *

UNITED STATES PATENT AND TRADEMARK OFFICE

CERTIFICATE OF CORRECTION

PATENT NO. : 4,781,618

DATED : November 1, 1988

INVENTOR(S) : Lawrence E. Geib & Herbert C. Naylor

It is certified that error appears in the above-identified patent and that said Letters Patent is hereby corrected as shown below:

Column 1, line 29, "iser-" should read --inser---

Column 2, line 16, "anular" should read --annular--

Column 2, line 39, "shpaed" should read --shaped--

Column 2, line 61, "opeing 16" should read --opening 16--

Column 4, line 7, "portions." should read --positions.--

Signed and Sealed this

Third Day of March, 1992

*Attest:*

HARRY F. MANBECK, JR.

*Attesting Officer*

*Commissioner of Patents and Trademarks*